US010513943B2

(12) United States Patent
McCaffrey

(10) Patent No.: US 10,513,943 B2
(45) Date of Patent: Dec. 24, 2019

(54) BOAS ENHANCED HEAT TRANSFER SURFACE

(71) Applicant: UNITED TECHNOLOGIES CORPORATION, Farmington, CT (US)

(72) Inventor: Michael G. McCaffrey, Windsor, CT (US)

(73) Assignee: United Technologies Corporation, Farmington, CT (US)

( * ) Notice: Subject to any disclaimer, the term of this patent is extended or adjusted under 35 U.S.C. 154(b) by 649 days.

(21) Appl. No.: 15/071,507

(22) Filed: Mar. 16, 2016

(65) Prior Publication Data

US 2017/0268370 A1 Sep. 21, 2017

(51) Int. Cl.

| | |
|---|---|
| ***F01D 11/08*** | (2006.01) |
| ***F01D 25/24*** | (2006.01) |
| ***F01D 9/04*** | (2006.01) |

(52) U.S. Cl.

CPC ..... *F01D 11/08* (2013.01); *F01D 9/04* (2013.01); *F01D 25/246* (2013.01); *F05D 2240/11* (2013.01); *F05D 2240/55* (2013.01); *F05D 2260/2214* (2013.01)

(58) Field of Classification Search

CPC ..... F01D 11/08; F01D 11/12; F01D 11/125; F01D 25/246; F01D 25/25; F05D 2240/11; F05D 2240/55

See application file for complete search history.

(56) References Cited

U.S. PATENT DOCUMENTS

| | | | | |
|---|---|---|---|---|
| 4,087,199 A | | 5/1978 | Hemsworth et al. | |
| 4,527,385 A | | 7/1985 | Jumelle et al. | |
| 4,728,257 A | | 3/1988 | Handschuh | |
| 5,353,865 A | | 10/1994 | Adiutori et al. | |
| 5,375,973 A | * | 12/1994 | Sloop | F01D 11/08 415/115 |
| 5,609,469 A | | 3/1997 | Worley et al. | |
| 5,639,210 A | | 6/1997 | Carpenter et al. | |

(Continued)

FOREIGN PATENT DOCUMENTS

| | | |
|---|---|---|
| WO | 2015038341 | 3/2005 |
| WO | 2015038906 | 3/2015 |

(Continued)

OTHER PUBLICATIONS

European Search Report for EP Application No. 17160076.0 dated Aug. 7, 2017.

*Primary Examiner* — Nicholas L Foster

(74) *Attorney, Agent, or Firm* — Carlson, Gaskey & Olds, P.C.

(57) ABSTRACT

A seal assembly includes a seal arc segment that defines first and second seal supports and radially inner and outer sides with the radially outer side including radially-extending sidewalls and a radially inner surface that joins the radially-extending sidewalls. The radially-extending sidewalls and the radially inner surface define a pocket. The seal assembly includes a carriage that defines first and second support members with the first support member supporting the seal arc segment in a first ramped interface and the second support member supporting the seal arc segment in a second ramped interface. The radially inner surface has a higher surface roughness than the radially extending sidewalls.

11 Claims, 7 Drawing Sheets

(56) References Cited

U.S. PATENT DOCUMENTS 6,142,731 A 11/2000 Dewis et al.
6,402,464 B1 * 6/2002 Chiu ..... F01D 5/288 165/133
6,431,825 B1 8/2002 McLean
6,726,448 B2 4/2004 McGrath et al.
6,733,235 B2 5/2004 Alford et al.
7,052,235 B2 5/2006 Alford et al.
7,163,206 B2 1/2007 Cross et al.
7,435,049 B2 10/2008 Ghasripoor et al.
7,527,472 B2 5/2009 Allen
7,959,407 B2 6/2011 Tholen
7,997,856 B2 * 8/2011 Khanin ..... F01D 11/08 415/116
8,123,466 B2 2/2012 Pietraszkiewicz et al.
8,303,247 B2 11/2012 Schlichting et al.
8,439,629 B2 * 5/2013 Pietraszkiewicz ..... F01D 11/08 415/116
8,439,636 B1 5/2013 Liang
8,534,995 B2 9/2013 McCaffrey
8,568,091 B2 10/2013 McCaffrey
8,585,357 B2 11/2013 DiPaola et al.
8,596,963 B1 12/2013 Liang
8,790,067 B2 7/2014 McCaffrey et al.
8,876,458 B2 11/2014 Thibodeau et al.
8,920,127 B2 12/2014 McCaffrey
8,944,756 B2 2/2015 Lagueux
9,039,358 B2 5/2015 Tholen et al.
9,103,225 B2 * 8/2015 Lutjen ..... F01D 11/08
9,115,596 B2 8/2015 Clouse
9,169,739 B2 10/2015 Mironets et al.
9,200,530 B2 12/2015 McCaffrey
9,228,447 B2 1/2016 McCaffrey
9,238,970 B2 * 1/2016 Thibodeau ..... F01D 11/001
10,138,750 B2 * 11/2018 McCaffrey ..... F01D 5/02
2006/0038358 A1 2/2006 James
2008/0211192 A1 9/2008 Pietraszkiewicz et al.
2009/0067994 A1 * 3/2009 Pietraszkiewicz ..... F01D 11/08 415/173.1
2009/0096174 A1 4/2009 Spangler et al.
2009/0169368 A1 7/2009 Schlichting et al.
2009/0208322 A1 8/2009 McCaffrey
2010/0047062 A1 * 2/2010 Khanin ..... F01D 11/08 415/175
2010/0226760 A1 9/2010 McCaffrey
2011/0044803 A1 2/2011 Di Paola et al.
2011/0044804 A1 2/2011 DiPaola et al.
2012/0177478 A1 * 7/2012 Giri ..... F01D 5/187 415/115
2012/0195743 A1 8/2012 Walunj et al.
2012/0251295 A1 * 10/2012 Turner ..... F01D 11/24 415/115
2012/0275898 A1 11/2012 McCaffrey et al.
2013/0017057 A1 1/2013 Lagueux
2013/0022469 A1 1/2013 McCaffrey
2013/0071227 A1 * 3/2013 Thibodeau ..... F01D 11/001 415/1
2013/0089434 A1 4/2013 Simpson et al.
2013/0113168 A1 5/2013 Lutjen et al.
2013/0170963 A1 * 7/2013 Mironets ..... F01D 11/12 415/173.1
2013/0209240 A1 8/2013 McCaffrey
2013/0323033 A1 * 12/2013 Lutjen ..... F01D 11/08 415/173.1
2014/0016761 A1 1/2014 Werner
2014/0017072 A1 1/2014 McCaffrey
2014/0023480 A1 1/2014 McCaffrey
2014/0033149 A1 1/2014 Groves et al.
2014/0044528 A1 2/2014 Clouse
2014/0053040 A1 2/2014 Hargan
2014/0127006 A1 5/2014 Romanov et al.
2014/0133955 A1 5/2014 McCaffrey et al.
2014/0186152 A1 7/2014 McCaffrey et al.
2015/0016954 A1 1/2015 Thibodeau et al.
2015/0031764 A1 1/2015 Kraus et al.
2015/0226132 A1 8/2015 Roy Thill et al.
2015/0300195 A1 * 10/2015 Lutjen ..... F01D 11/08 415/1
2015/0337672 A1 11/2015 McCaffrey et al.
2015/0369076 A1 12/2015 McCaffrey et al.
2016/0003078 A1 1/2016 Stevens et al.
2016/0003080 A1 1/2016 Mcgarrah
2016/0194980 A1 * 7/2016 Thomen ..... F04D 29/542 415/1
2017/0101932 A1 * 4/2017 Stover ..... F01D 5/189
2017/0211404 A1 * 7/2017 McCaffrey ..... F01D 11/08
2017/0268363 A1 * 9/2017 McCaffrey ..... F01D 9/041
2017/0268364 A1 * 9/2017 McCaffrey ..... F01D 9/041
2017/0268371 A1 * 9/2017 McCaffrey ..... F01D 5/02
2019/0048736 A1 * 2/2019 McCaffrey ..... F01D 5/02

FOREIGN PATENT DOCUMENTS

WO 2015047478 4/2015
WO 2015061108 4/2015
WO 2015088656 6/2015
WO 2015109292 7/2015
WO 2015112354 7/2015
WO 2016025054 2/2016

* cited by examiner

BOAS ENHANCED HEAT TRANSFER SURFACE

BACKGROUND OF THE INVENTION

A gas turbine engine typically includes at least a compressor section, a combustor section and a turbine section. The compressor section pressurizes air into the combustion section where the air is mixed with fuel and ignited to generate an exhaust gas flow. The exhaust gas flow expands through the turbine section to drive the compressor section and, if the engine is designed for propulsion, a fan section.

The turbine section may include multiple stages of rotatable blades and static vanes. An annular shroud or blade outer air seal may be provided around the blades in close radial proximity to the tips of the blades to reduce the amount of gas flow that escapes around the blades. The shroud typically includes a plurality of arc segments that are circumferentially arranged. The arc segments may be abradable to reduce the radial gap with the tips of the blades.

SUMMARY OF THE INVENTION

A seal assembly according to an example of the present disclosure includes a seal arc segment that defines first and second seal supports and radially inner and outer sides. The radially outer side includes radially-extending sidewalls and a radially inner surface that joins the radially-extending sidewalls. The radially-extending sidewalls and the radially inner surface define a pocket. The seal assembly includes a carriage that defines first and second support members with the first support member supporting the seal arc segment in a first ramped interface and the second support member supporting the seal arc segment in a second ramped interface. The radially inner surface has a higher surface roughness than the radially extending sidewalls.

In a further embodiment of any of the foregoing embodiments, the radially inner surface defines a plurality of channels.

In a further embodiment of any of the foregoing embodiments, the radially inner surface has a first section and a second section spaced axially from the first section, and the channels are deeper in the first section than in the second section.

In a further embodiment of any of the foregoing embodiments, the radially inner surface has a first section and a second section spaced axially from the first section, and the channels are spaced farther apart in the first section than in the second section.

In a further embodiment of any of the foregoing embodiments, the channels separate a plurality of fins.

In a further embodiment of any of the foregoing embodiments, the channels are circumferentially extending.

In a further embodiment of any of the foregoing embodiments, the seal arc segment comprises ceramic.

In a further embodiment of any of the foregoing embodiments, the radially inner surface has a first section and a second section spaced axially from the first section, and the surface roughness at the first section is different than the surface roughness of the second section.

A method of manufacturing a seal according to an example of the present disclosure includes providing a seal arc segment that defines first and second seal supports at circumferential ends. The seal arc segment further defines radially inner and outer sides, and the radially outer side includes radially-extending sidewalls and a radially inner surface that joins the radially-extending sidewalls. The radially-extending sidewalls and the radially inner surface define a pocket. The method further includes machining the radially inner surface to have a higher surface roughness than the sidewalls.

A further embodiment of any of the foregoing embodiments includes machining circumferentially-extending channels in the radially inner surface.

A further embodiment of any of the foregoing embodiments includes machining a channel of a first depth at a first section of the radially inner surface, and machining a channels deeper than the first depth at a second section of the radially inner surface, wherein the first section is axially spaced from the second section.

A further embodiment of any of the foregoing embodiments includes machining channels spaced apart a first distance at a first section of the surface, and machining channels spaced apart a second distance at a second section of the radially inner surface, the first section axially spaced from the section, and the first distance different from the second distance.

A further embodiment of any of the foregoing embodiments includes machining a channel of a first width at a first section of the radially inner surface, and machining a channels wider than the first width at a second section of the radially inner surface, wherein the first section is axially spaced from the second section.

A further embodiment of any of the foregoing embodiments includes machining a first surface roughness at a first section of the radially inner surface, and machining a second surface roughness at a second section of the radially inner surface, wherein the first section is axially spaced from the second section, the first surface roughness is different from the second surface roughness, and the first surface roughness and the second surface roughness are greater than the surface roughness of the sidewalls.

In a further embodiment of any of the foregoing embodiments, the seal arc segment comprises ceramic.

In a further embodiment of any of the foregoing embodiments, the machining is done in the bisque state.

A rotor assembly according to an example of the present disclosure includes a rotor rotatable about an axis and a seal arc segment radially outward of the rotor. The seal arc segment defines first and second seal supports and radially inner and outer sides. The radially outer side includes radially-extending sidewalls and a radially inner surface that joins the radially-extending sidewalls, and the radially-extending sidewalls and the radially inner surface define a pocket. A carriage defines first and second support members. The first support member supports the seal arc segment in a first ramped interface, and the second support member supporting the seal arc segment in a second ramped interface. The radially inner surface defines a plurality of peaks and a plurality of valleys.

In a further embodiment of any of the foregoing embodiments, the peaks and valleys are arranged in a non-random pattern.

In a further embodiment of any of the foregoing embodiments, the first and second seal supports are defined at first and second circumferential ends of the seal arc segment.

In a further embodiment of any of the foregoing embodiments, the first and second seal supports have a dovetail geometry.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
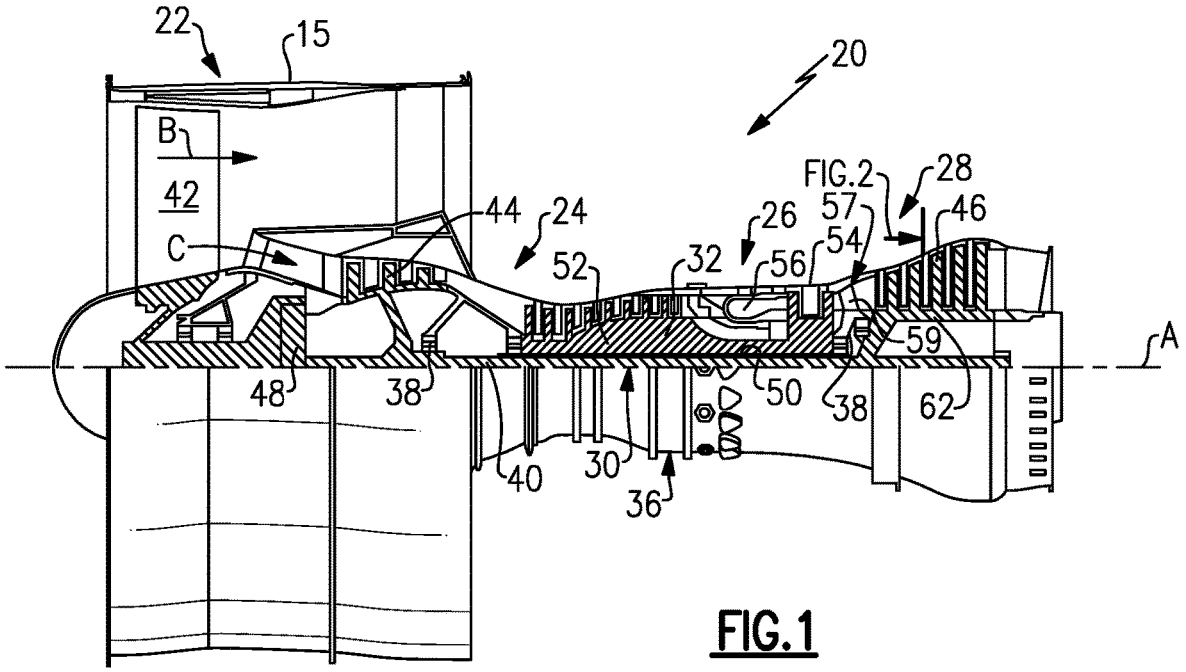
FIG. 1 illustrates a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engine designs can include an augmentor section (not shown) among other systems or features.

The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, the examples herein are not limited to use with two-spool turbofans and may be applied to other types of turbomachinery, including direct drive engine architectures, three-spool engine architectures, and ground-based turbines.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48, to drive the fan 42 at a lower speed than the low speed spool 30.

The high speed spool 32 includes an outer shaft 50 that interconnects a second (or high) pressure compressor 52 and a second (or high) pressure turbine 54. A combustor 56 is arranged between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports the bearing systems 38 in the turbine section 28. The inner shaft 40 and the outer shaft 50 are concentric and rotate via bearing systems 38 about the engine central longitudinal axis A, which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines, including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of 1 bm of fuel being burned divided by 1 bf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second.

Figure 2:
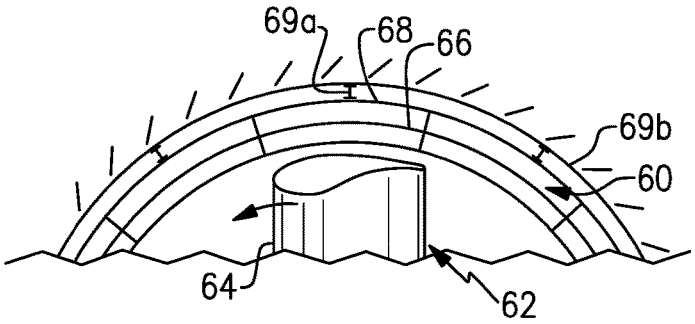
FIG. 2 illustrates an axial view of a seal assembly of a gas turbine engine.

FIG. 2 illustrates a partial axial view through a portion of one of the stages of the turbine section 28. In this example, the turbine section 28 includes an annular blade outer air seal (BOAS) system or assembly 60 (hereafter BOAS 60) that is located radially outwards of a rotor 62 that has a row of rotor blades 64. As can be appreciated, the BOAS 60 can alternatively or additionally be adapted for other portions of the engine 20, such as the compressor section 24.

The BOAS 60 includes a plurality of seal arc segments 66 that are circumferentially arranged in an annulus around the central axis A of the engine 20. The seal arc segments 66 are mounted in a carriage 68, which may be continuous or segmented. The carriage 68 is mounted through one or more connections 69*a* to a case structure 69*b*. The BOAS 60 is in close radial proximity to the tips of the blades 64, to reduce the amount of gas flow that escapes around the blades 64.

Figure 3:
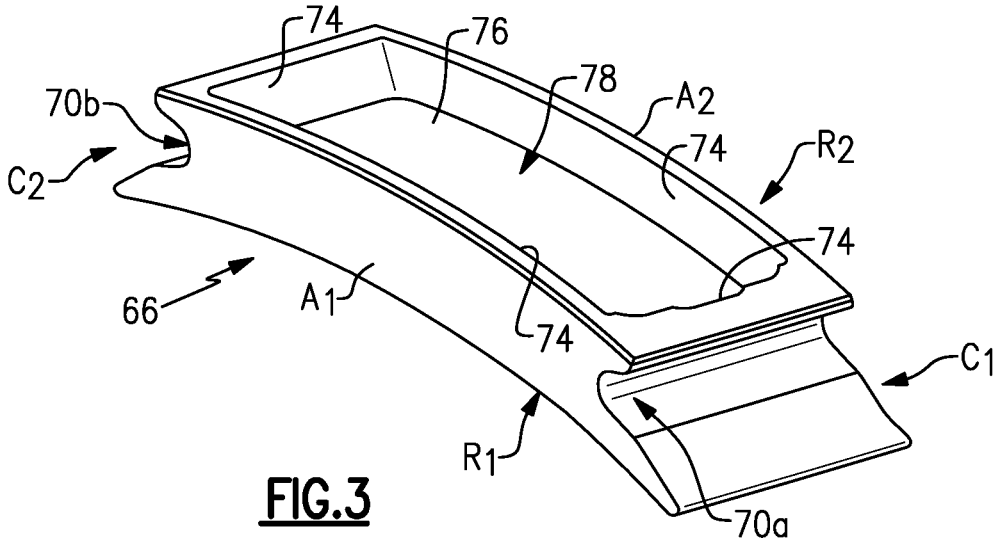
FIG. 3 illustrates an isolated view of a seal arc segment of a seal assembly.
Figure 4:
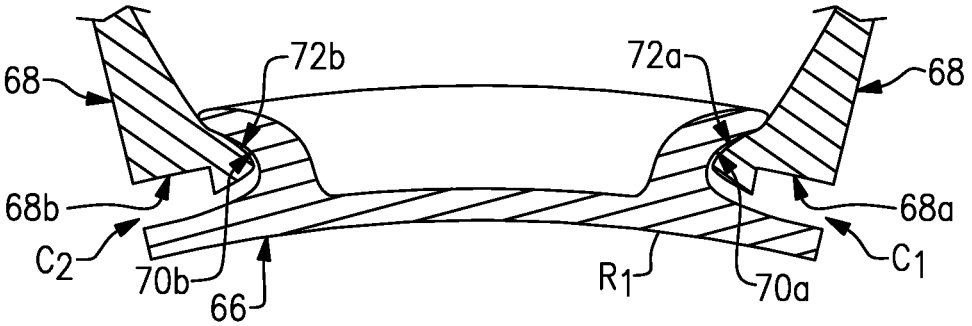
FIG. 4 illustrates a seal arc segmented mounted in a carriage.

FIG. 3 illustrates an isolated view of a representative one of the seal arc segments 66, and FIG. 4 illustrates a view of the seal arc segment 66 mounted in a portion of the carriage 68. As will be appreciated, the examples herein may be used to provide compliant, low-stress mounting of the seal arc segment 66 in the carriage 68. In particular such compliant low-stress mounting may be useful for seal arc segments 66 formed of materials that are sensitive to stress concentrations, although this disclosure is not limited and other types of seals and materials will also benefit.

Although not limited, the seal arc segments 66 (i.e., the body thereof) may be monolithic bodies that are formed of a high thermal-resistance, low-toughness material. For example, the seal arc segments 66 may be formed of a high thermal-resistance low-toughness metallic alloy or a ceramic-based material, such as a monolithic ceramic or a ceramic matrix composite. One example of a high thermal-resistance low-toughness metallic alloy is a molybdenum-based alloy. Monolithic ceramics may be, but are not limited to, silicon carbide (SiC) or silicon nitride ($Si_3N_4$). Alternatively, the seal arc segments 66 may be formed of high-toughness material, such as but not limited to metallic alloys.

Each seal arc segment 66 is a body that defines radially inner and outer sides R1/R2, first and second circumferential ends C1/C2, and first and second axial sides A1/A2. The radially inner side R1 faces in a direction toward the engine central axis A. The radially inner side R1 is thus the gas path side of the seal arc segment 66 that bounds a portion of the core flow path C. The first axial side A1 faces in a forward direction toward the front of the engine 20 (i.e., toward the fan 42), and the second axial side A2 faces in an aft direction toward the rear of the engine 20 (i.e., toward the exhaust end).

In this example, the first and second circumferential ends C1/C2 define, respectively, first and second seal supports 70*a*/70*b* by which the carriage 68 radially supports or suspends the seal arc segment 66. The seal arc segment 66 is thus end-mounted. In the example shown, the first and second seal supports 70*a*/70*b* have a dovetail geometry.

The carriage 68 includes first and second support members 68*a*/68*b* that serve to radially support the seal arc segment 66 via, respectively, the first and second seal supports 70*a*/70*b*. In the example shown, the first and second support members 68*a*/68*b* are hook supports that interfit with the dovetail geometry of the first and second seal supports 70*a*/70*b*.

The first support member 68*a* supports the seal arc segment 66 in a first ramped interface 72*a* and the second support member 68*b* supports the seal arc segment 66 in a second ramped interface 72*b*. For instance, each of the ramped interfaces 72*a*/72*b* includes at least one ramped surface on the seal arc segment, the carriage 68, or both. In the example shown, the surfaces of the first and second seal supports 70*a*/70*b* and the surfaces of the first and second support members 68*a*/68*b* are ramped. The term "ramped" as used herein refers to a support surface that is sloped with respect to both the radial and circumferential directions.

The ramped interfaces 72*a*/72*b* permit the seal arc segment 66 to move circumferentially with respect to the carriage 68 as the seal arc segment 66 slides up and down the ramped interfaces 72*a*/72*b*. Friction in the ramped interfaces 72*a*/72*b* during sliding movement can potentially provide damping, and the relatively large contact area across the ramped interfaces 72*a*/72*b* distributes loads transferred through the ramped interfaces 72*a*/72*b*, which also serves to potentially reduce stress concentrations on the seal arc segment 66.

The radially outer side R2 of the seal arc segment 66 includes radially-extending rails or sidewalls 74 (FIG. 3) and a radially inner or innermost surface 76 that joins the sidewalls 74. The sidewalls 74 and the radially inner surface 76 define a pocket 78 on the radially outer side R2 of the seal arc segment 66. In this example, the pocket 78 is open on its radially outer side.

In one example, the pocket 78 extends a majority of the circumferential length of the seal arc segment 66. The pocket 78 may also extend a majority of the axial length of the seal arc segment 66.

Figure 5:
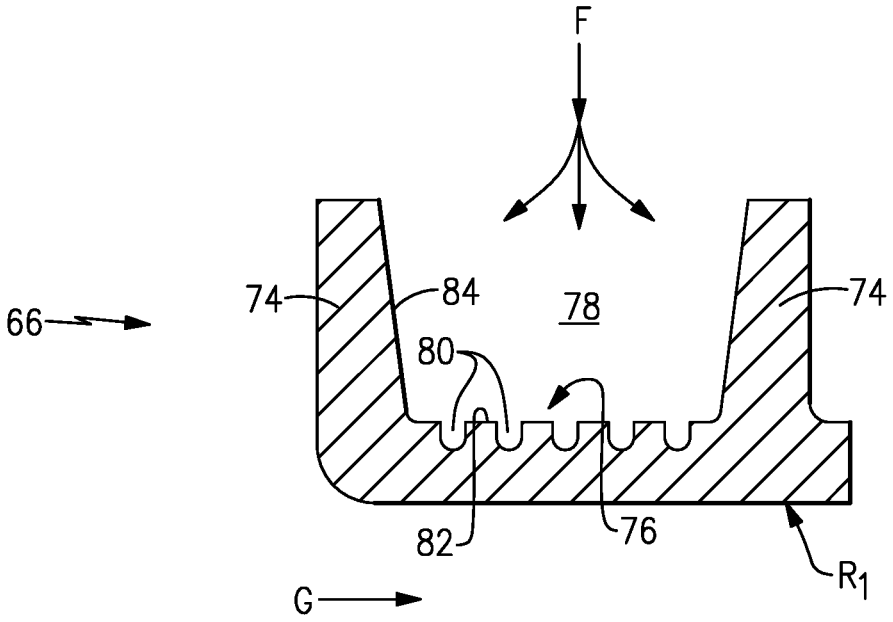
FIG. 5 illustrates an example inner surface of pocket of a seal arc segment.

As illustrated in FIG. 5, a plurality of channels or tunnels or valleys 80 may be formed in the radially inner surface 76 of the pocket 78. The channels 80 may be spaced apart to provide a plurality of fins or peaks 82 at the surface 76. The channels 80 and fins 82 provide the surface 76 a greater surface area than the surface area of the smooth surface 84 of the radially extending sidewalls 74. The greater surface area increases the local convective heat transfer coefficient (HTC). In one example, the channels 80 are elongated. The greater surface area can increase the overall surface roughness of the surface 76 or at a section of the surface 76.

The surface 76 is proximal to the hot gas flowpath G at the radial end R1 of the arc seal segment 66. A fluid F may be directed into the pocket 78 to cool the radially inner surface 76. Due to the increased HTC of the surface 76 with the higher surface area, the fluid F can more efficiently cool the surface 76 than if the surface 76 were relatively smooth. The fluid F may be from the compressor section 24.

In one example, the channels 80 extend circumferentially and are substantially parallel to each other. The fins 82 in turn also extend circumferentially and are substantially parallel to each other. The channels 80 and fins 82 may extend substantially the entire circumferential distance of the pocket 78. As one alternative, the channels 80 and fins 82 may be limited to circumferential sections of the pocket 78. As two non-limiting examples, the channels 80 may be round-bottomed channels or flat-bottomed channels.

Because the inner surface 76 is a relatively low stress area of the seal arc segment 66, there will not be a large reduction in fracture strength of the seal arc segment 66 if channels 80 are formed into the surface 76.

Figure 6:
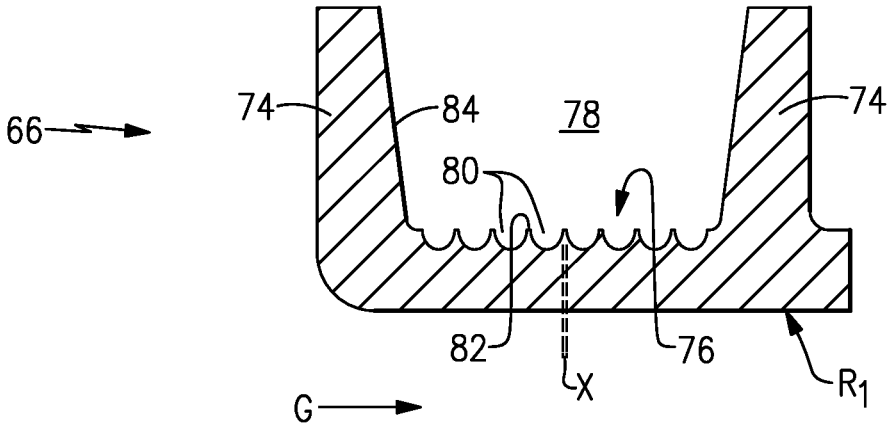
FIG. 6 illustrates another example inner surface of pocket of a seal arc segment.

As illustrated in FIG. 6, the distance X between the channels 80 may be varied. Varying the distance X between the channels 80 also varies the shape of the fins 82. For example, a minimal distance X between channels 80 may create a pointed fin 82, while a greater distance X between the channels 80 may create a flat fin 82 having a flat radially outer surface 83.

Figure 7:
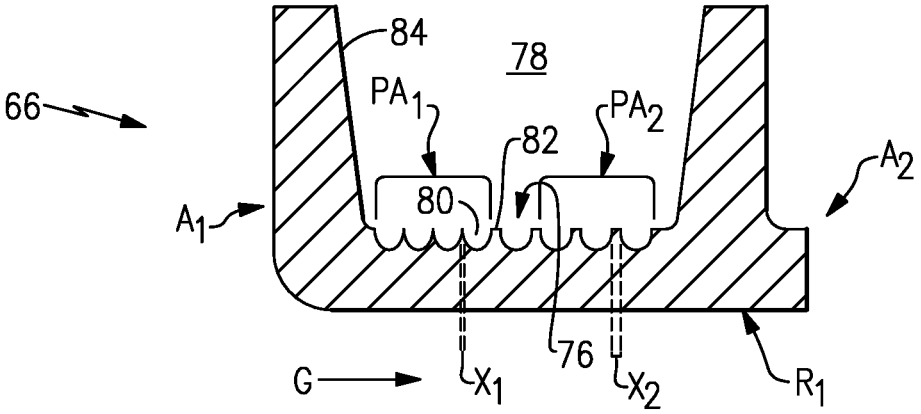
FIG. 7 illustrates another example inner surface of pocket of a seal arc segment.

As shown in FIGS. 7-10, the local convective heat transfer coefficient can be locally or sectionally modified in the surface 76. As one example of locally modifying the heat transfer coefficient, as illustrated in FIG. 7, the distance X1 between the channels 80 at axial section PA1 of the inner surface 76 may be different from the distance X2 between the channels 80 at the second axial section PA2 of the inner surface 76. Varying distance X between channels 80 in the axial direction may allow for a higher heat transfer coefficient at one of the axial sections PA1 and PA2 of the inner surface 76 than at the other of the axial sections PA1 and PA2.

Figure 8:
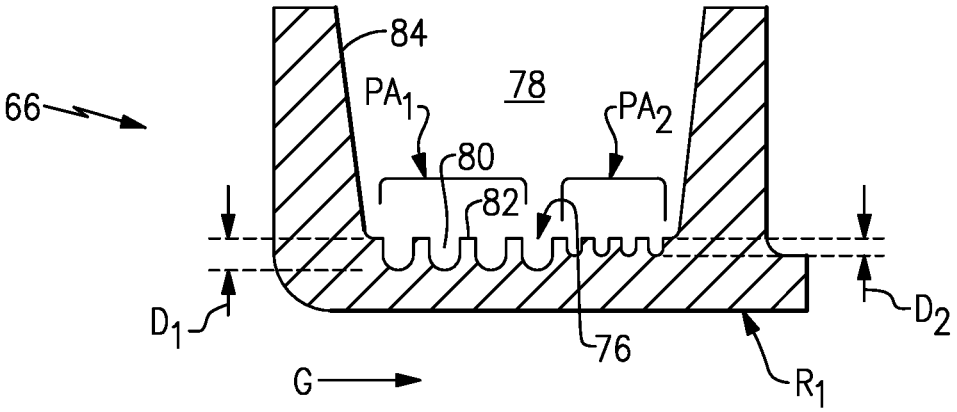
FIG. 8 illustrates another example inner surface of pocket of a seal arc segment.

As shown in FIG. 8, as another example of locally modifying the heat transfer coefficient of the surface 76, the depth of the channels 80 may also be varied. In this example, the depth D1 of the channels 80 at the axial section PA1 of the inner surface 76 is greater than the depth D2 of the channels 80 at the second axial section PA2 of the inner surface 76. A greater depth D1 of the channels 80 at the section PA1 may allow for a higher heat transfer coefficient at the section PA1 than at the section PA2, where the channels 80 have a lesser depth D2.

Figure 9:
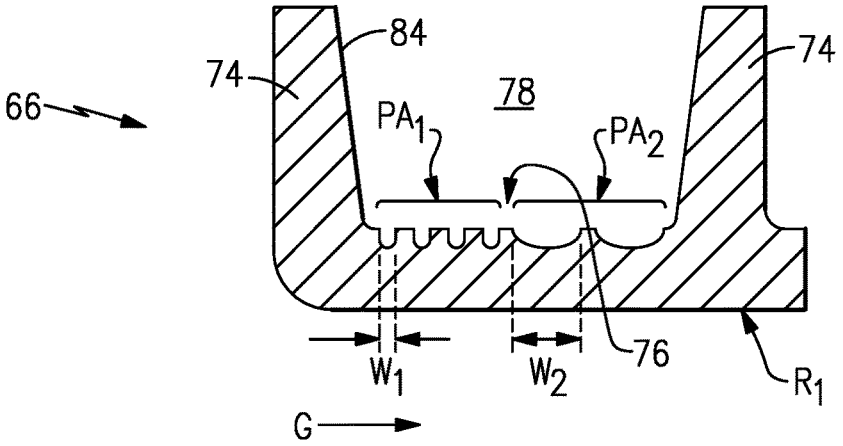
FIG. 9 illustrates another example inner surface of pocket of a seal arc segment.

As illustrated in FIG. 9, as another example of locally modifying the heat transfer coefficient of the surface 76, the width W of the channels 80 may be varied. As shown, the width W1 of the channels 80 at section PA1 of the inner surface 76 may be less than the width W2 of the channels 80 at the section PA2 of the inner surface 76.

Figure 10:
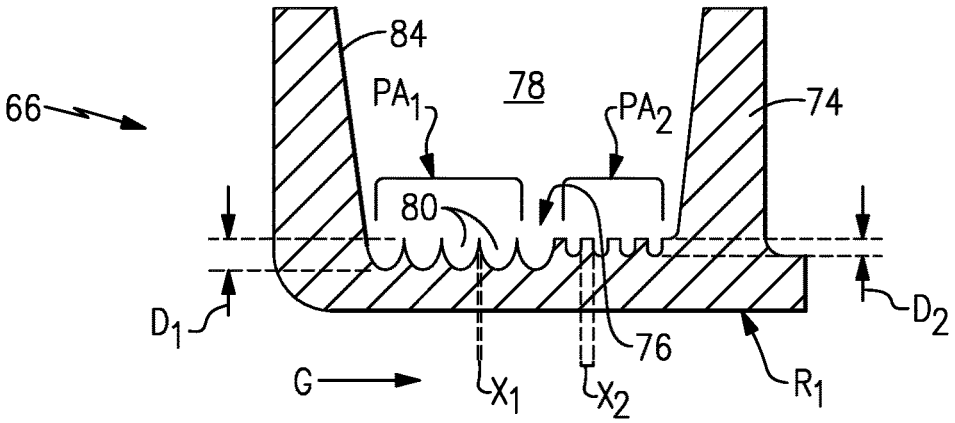
FIG. 10 illustrates another example inner surface of pocket of a seal arc segment.

More than one of the spacing X, the depth D, and the width W of the channels 80 may be varied for a single surface 76 to localize a higher heat transfer coefficient at a targeted section of the surface 76. As illustrated in FIG. 10, as another example of locally modifying the heat transfer coefficient of the surface 76, both the depth and spacing between the channels 80 may be varied. In the example shown, the depth D1 of the channels 80 at the first axial section PA1 is greater than the depth of D2 of the channels 80 at the second axial section PA2. The distance X2 between the channels 80 at the second axial section PA2 is greater than the distance between the channels 80 at the first axial section PA1 of the inner surface 76.

Although the embodiments shown vary the radial depth of the channels 80 and the axial spacing of the channels 80, the surface area of the inner surface 76 may also be varied in the circumferential direction. Further, more than two distinct areas can be utilized, such that the surface area can be localized at multiple areas of the surface 76.

Since the gaspath G flows from the axial end A1 to the axial end A2, as shown, it may be desirable to have a higher heat transfer coefficient at the axial end A1 than at the axial end A2 because the axial end A1 experiences hotter gas temperatures than the axial end A2. Machining the channels 80 such that the surface area of the surface 76 at the section PA1 is greater than the surface area of the surface 76 at PA2 would increase the heat transfer coefficient of the seal arc segment 66 at the axial end A1 relative to the axial end A2. This increased heat transfer coefficient at the axial end A1 can be achieved in one or more of the embodiments described herein by varying the spacing X, the depth D, and the width W of the channels 80.

The design of the local convective heat transfer coefficient modifier on surface 76 is dependent upon many factors. Local Gaspath G variation in temperature, pressure and velocity may affect the temperature and heat load on surface R1 in very local manner, and may necessitate a local zone of high convective heat transfer coefficient with in particular sections such as PA1 and PA2. Surface channel 80, may further be defined in a very local sub-section both axially and circumferentially with geometrical dimensions which are different than adjacent sub-sections and sections.

Figure 11:
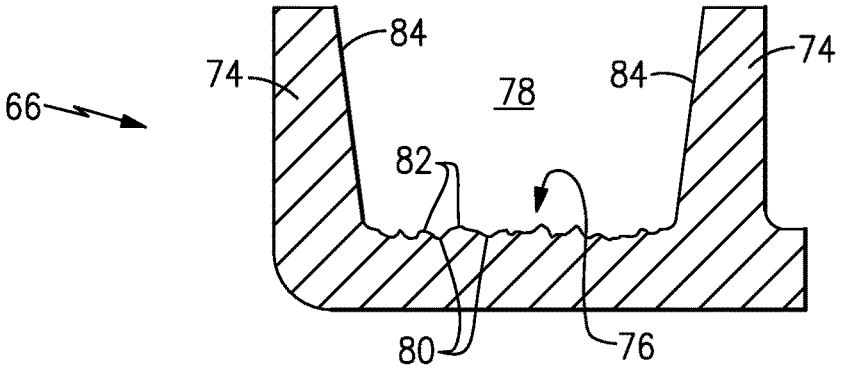
FIG. 11 illustrates another example inner surface of pocket of a seal arc segment.

As illustrated in FIG. 11, a surface roughness in the surface 76 may not be patterned or symmetrical in the radial, axial, or circumferential directions. The roughness may be a random roughness formed from machining or mechanical abrasion, forming a plurality of peaks 82 and valleys 80 in the surface 76.

In the embodiments disclosed, the inner surface 76 of the pocket 78 is formed with a higher surface area than the radial face surfaces 84 of the sidewalls 74. The increased surface area of the surface 76 relative to the radial face surfaces 84 results in a higher heat transfer coefficient in the surface 76 than in the radial face surfaces 84. Because of its proximity to the gaspath surface at the end R1 of the seal arc segment 66, the inner surface 76 of the pocket 78 experiences hotter temperatures than the sidewalls 74. A higher heat transfer coefficient of the surface 76 relative to the radial face surfaces 84 of the sidewalls 74 allows the fluid F to cool the surface 76 more efficiently than the surfaces 84. This relationship maintains the temperature at the sidewalls 74 closer to the temperature of rest of the seal arc segment 66, thereby reducing the thermal stresses in the seal arc segment 66 by reducing the thermal gradient.

Figure 12:
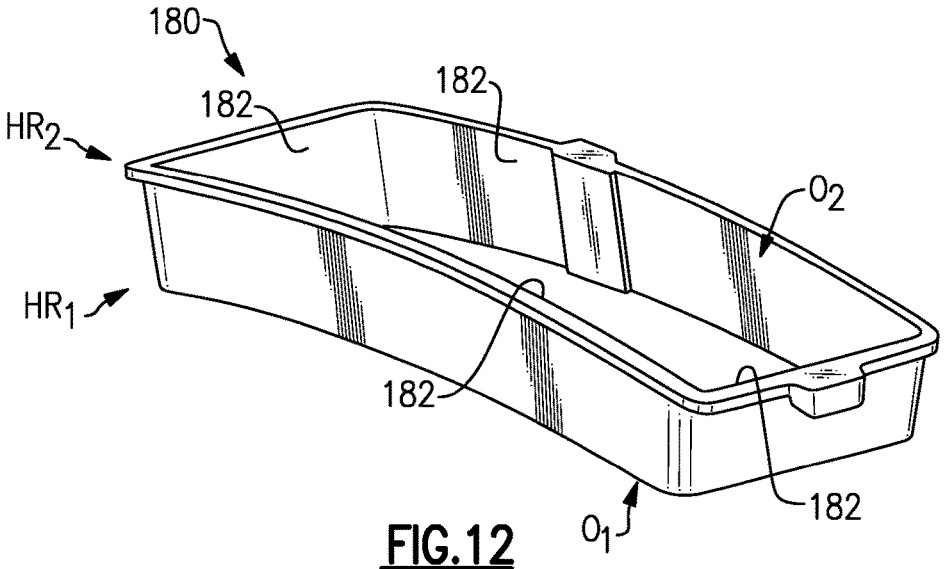
FIG. 12 illustrates an example rail shield.
Figure 13:
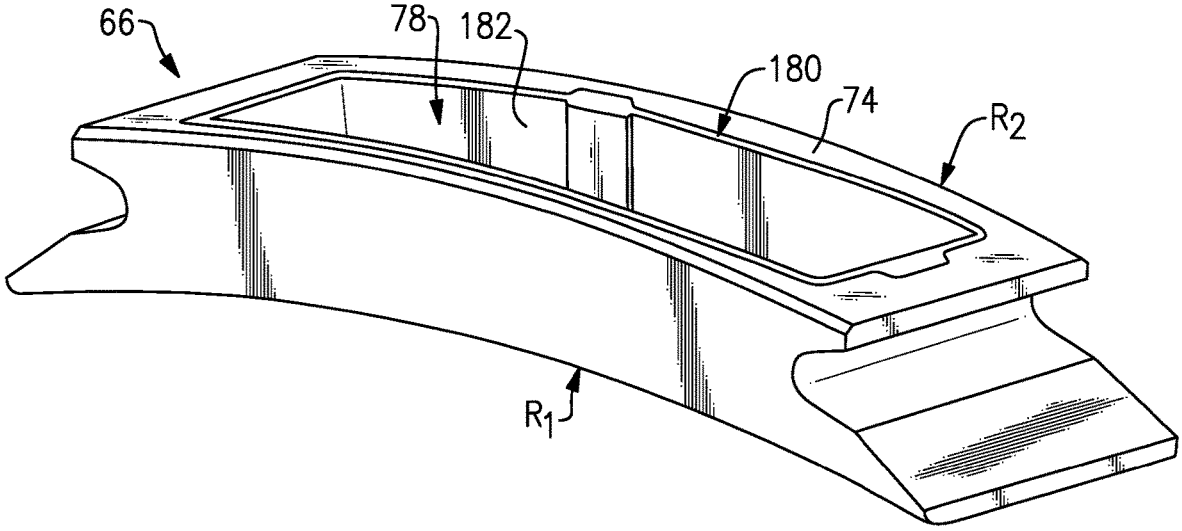
FIG. 13 illustrates a rail shield arranged in the seal arc segment.
Figure 14:
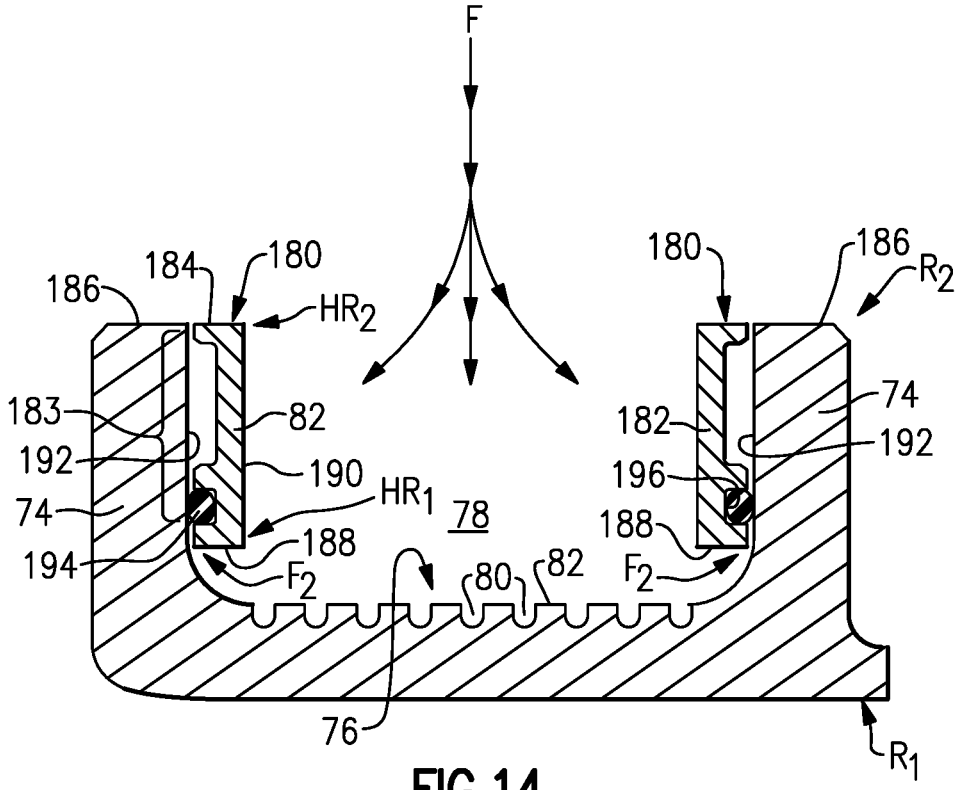
FIG. 14 illustrates a rail shield arranged in the seal arc segment.

As illustrated in FIGS. 12-14, to further improve the thermal gradient of the seal arc segment 66, a rail shield 180 may be arranged in the pocket 78 of the seal arc segment 66. The rail shield 180 includes radially-extending walls 182, forming an opening O1 at the radial end HR1 and an opening O2 at the opposite radial end HR2. The rail shield 180 in this example is thus an endless band. The rail shield 180 is received in the pocket 78 such that the walls 182 line the radially extending sidewalls 74 of the pocket 78. Such a lining arrangement may or may not include contact between the walls 182 and the sidewalls 74. With the rail shield 180 in the pocket 78, the pocket 78 is still substantially open at the radial end R2 of the seal arc segment 66.

The circumferential length of the opening O1 may substantially equal a majority of the circumferential length of the seal arc segment 66. The axial length of the opening O1 may substantially equal a majority of the axial length of the seal arc segment 66. The circumferential length of the opening O2 may substantially equal a majority of the circumferential length of the seal arc segment 66. The axial length of the opening O2 may substantially equal a majority of the axial length of the seal arc segment 66.

The walls 182 of the rail shield 180 serve as the protective barrier against direct exposure of the radially extending sidewalls 74 of the seal arc segment 66 to the fluid F. The radially outer surface 184 of the rail shield 180 may be radially flush with the radially outer surface 186 of the arc seal segment 66. The radial face surface 190 of the rail shield 180, the radially inner surface 76 (having an increased surface area) of the pocket 78, and the radially inner surface 188 of the rail shield 180 are exposed to the fluid flow F. The inner surface 192 of the sidewalls 74, extending radially along the section 183, are not directly exposed to the fluid.

A seal 194 may be contiguous with the inner surface 192 of the sidewalls 74. The seal 194 is arranged between the sidewalls 74 and the rail shield 180. The seal 194 may be adjacent the radial end HR1 of the rail shield 180. In this example, the seal 194 is received in a groove 196 of the rail shield 180, such that the seal 194 is axially between the rail shield 180 and the sidewalls 74. In this example, the section 183 extends radially from the seal 194 to the radial end HR2 of the rail shield 180. Alternatively, if a seal 194 were not utilized, the section 183 may extend from the axial end HR1 to the axial end HR2 of the rail shield 180. The seal 194 effectively seals the section 183 of the inner surface 192 of the sidewalls 74 from the component F2 of the fluid flow F. When the inner surface 192 of the sidewalls 74 are not directly exposed to the fluid flow F, the temperature at the sidewalls 74 is maintained closer to the temperature of rest of the seal arc segment 66, thereby reducing the thermal stresses in the seal arc segment 66 by reducing the thermal gradient.

In one example, the seal 194 is a ceramic rope seal having a braided metallic sheath around a ceramic core. The metallic sheath may be a nickel or cobalt alloy, for example. As another example, the sheath is made from Haynes 188 alloy. The ceramic may be an aluminum oxide ceramic fiber.

Although not limited, another example seal 194 type is a finger seal—a thin flexible piece of sheet metal contiguous with the radially-extending sidewalls 74.

The rail shield 180 may be a metallic alloy, such as a nickel alloy or a cobalt alloy, for example. The rail shield 180 may thus grow thermally at a faster rate than the high thermal resistance material seal arc segment 66. The seal 194 may allow the rail shield 180 to be spaced from the sidewalls 74 such that the thermal expansion of the rail shield 180 will not place stresses on the ceramic seal arc segment 66.

Figure 15:
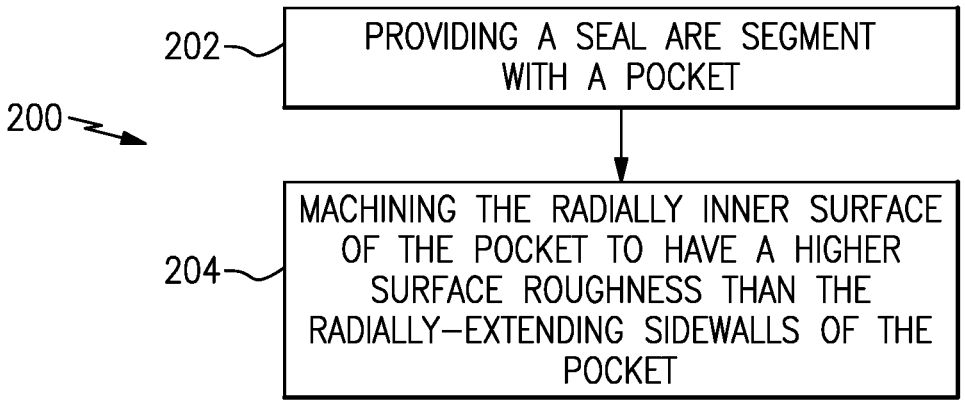
FIG. 15 illustrates a method for manufacturing a seal.

FIG. 15 illustrates a method for manufacturing a BOAS 60. At 202, a seal arc segment 66 is provided with a pocket 78. At 204, the radially inner surface 76 of the pocket 78 is machined to have a higher overall surface roughness than the radially extending sidewalls 74 of the pocket 78.

When ceramic is utilized as a material for the seal arc segment 66, the pocket 78 may be machined in the bisque state—the state before sintering to form the final densified ceramic, but after an intermediate heat treatment to the green state material. The channels 80 may also be machined into the surface 76 of the pockets 78 when the seal arc segment 66 is in the bisque state. In the bisque state, the ceramic is relatively soft such that simple machining operations with conventional machining tools can be used to achieve desired shapes, unlike in the sintered state where diamond tools are required for such machining operations.

The channels 80 may be round-bottomed channels. The distance between the channels 80 may vary from 0.025-0.050 inches. In one example, the $R_a$ value of the surface 76 is approximately 1000 to 5000 microinches, and the $R_a$ value of the relatively smooth surfaces 84 of the sidewall 74 is approximately 64 to 250. The channels 80 may be include pointed fins 82 with a distance between fins 82 varying from 0.04" to 0.10."

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

The invention claimed is:

1. A seal assembly comprising:

a seal arc segment defining first and second seal supports and radially inner and outer sides, wherein the first seal support is circumferentially spaced from the second seal support with respect to the seal arc segment, the radially outer side including four contiguous radially-extending sidewalls and a radially inner surface joining the radially-extending sidewalls, the radially-extending sidewalls and the radially inner surface defining a pocket, the first seal support extending from a first of the radially-extending sidewalls, and the second seal support extending from a second of the radially extending sidewalls circumferentially opposite the first of the radially-extending sidewalls;

a carriage defining first and second circumferentially spaced support members, the first support member supporting the first seal support of the seal arc segment in a first ramped interface and the second support member supporting the second seal support of the seal arc segment in a second ramped interface, wherein the radially inner surface has a higher surface roughness than the radially extending sidewalls.

2. The seal assembly as recited in claim 1, wherein the radially inner surface defines a plurality of channels.

3. The seal assembly as recited in claim 2, wherein the radially inner surface has a first section and a second section spaced axially from the first section, and the channels are deeper in the first section than in the second section.

4. The seal assembly as recited in claim 2, wherein the radially inner surface has a first section and a second section spaced axially from the first section, and the channels are spaced farther apart in the first section than in the second section.

5. The seal assembly as recited in claim 2, wherein the channels separate a plurality of fins.

6. The seal assembly as recited in claim 2, wherein the channels are circumferentially extending.

7. The seal assembly as recited in claim 1, wherein the seal arc segment comprises ceramic.

8. The seal assembly as recited in claim 1, wherein the radially inner surface has a first section and a second section spaced axially from the first section, and the surface roughness at the first section is different than the surface roughness of the second section.

9. The seal assembly as recited in claim 2, wherein the channels are round-bottomed channels.

10. A rotor assembly comprising:

a rotor rotatable about an axis;

a seal arc segment radially outward of the rotor and defining first and second seal supports and radially inner and outer sides, wherein the first seal support is circumferentially spaced from the second seal support with respect to the seal arc segment, the radially outer side including four contiguous radially-extending sidewalls and a radially inner surface joining the radially-extending sidewalls, the radially-extending sidewalls and the radially inner surface defining a pocket, the first seal support extending from a first of the radially-extending sidewalls, and the second seal support extending from a second of the radially extending sidewalls circumferentially opposite the first of the radially-extending sidewalls;

a carriage defining first and second circumferentially spaced support members, the first support member supporting the first seal support of the seal arc segment in a first ramped interface and the second support member supporting the second seal support of the seal arc segment in a second ramped interface, wherein the radially inner surface has a higher surface roughness than the radially extending sidewalls.

11. The rotor assembly as recited in claim 10, wherein the radially inner surface defines a plurality of peaks and valleys, and the peaks and valleys are arranged in a non-random pattern.

* * * * *